US012791215B2

(12) United States Patent
Hirayama et al.

(10) Patent No.: US 12,791,215 B2
(45) Date of Patent: Nov. 10, 2026

(54) INFORMATION OUTPUT APPARATUS FOR PERFORMING UPDATE RE-NOTIFICATION BASED ON USER'S OPERATION

(71) Applicant: SHARP KABUSHIKI KAISHA, Sakai City (JP)

(72) Inventors: Daigo Hirayama, Sakai City (JP); Yoshiki Koizumi, Sakai City (JP)

(73) Assignee: SHARP KABUSHIKI KAISHA, Sakai City (JP)

( * ) Notice: Subject to any disclaimer, the term of this patent is extended or adjusted under 35 U.S.C. 154(b) by 381 days.

(21) Appl. No.: 18/503,340

(22) Filed: Nov. 7, 2023

(65) Prior Publication Data

US 2024/0175593 A1 May 30, 2024

(30) Foreign Application Priority Data

Nov. 24, 2022 (JP) ..... 2022-187433

(51) Int. Cl.

| | |
|---|---|
| ***G06F 9/44*** | (2018.01) |
| ***F24F 11/52*** | (2018.01) |
| ***F24F 11/58*** | (2018.01) |
| ***F24F 11/61*** | (2018.01) |

(52) U.S. Cl.

CPC ..... *F24F 11/58* (2018.01); *F24F 11/52* (2018.01); *F24F 11/61* (2018.01)

(58) Field of Classification Search

CPC ..... F24F 11/58; F24F 11/52; F24F 11/61

See application file for complete search history.

(56) References Cited

U.S. PATENT DOCUMENTS

| | | | | |
|---|---|---|---|---|
| 2006/0059481 | A1* | 3/2006 | Smith | G06F 8/65 717/173 |
| 2006/0174242 | A1* | 8/2006 | Zhu | G06F 8/65 717/172 |
| 2016/0253471 | A1* | 9/2016 | Volpe | A61N 1/3968 607/5 |

FOREIGN PATENT DOCUMENTS

| | | | |
|---|---|---|---|
| JP | 2018086894 | A | 6/2018 |
| JP | 2019-211882 | A | 12/2019 |

* cited by examiner

*Primary Examiner* — Hang Pan

(74) *Attorney, Agent, or Firm* — ScienBiziP, P.C.

(57) ABSTRACT

An air conditioner according to the disclosure includes a communication unit, a determination unit, an output unit, and a control unit. The communication unit receives first information. The first information indicates that update preparation for the air conditioner has been completed, the air conditioner being configured to issue a notification indicating that control information is updatable. The determination unit determines whether current time has reached preset first time. The output unit outputs the second information. The second information indicates that the air conditioner can be updated. When the communication unit receives the first information and the determination unit determines that the current time has reached the first time, the control unit makes the output unit to output the second information.

5 Claims, 11 Drawing Sheets

INFORMATION OUTPUT APPARATUS FOR PERFORMING UPDATE RE-NOTIFICATION BASED ON USER'S OPERATION

CROSS-REFERENCE TO RELATED APPLICATIONS

This application claims the benefit of priority to Japanese Patent Application Number 2022-187433 filed on Nov. 24, 2022. The entire contents of the above-identified application are hereby incorporated by reference.

BACKGROUND

Technical Field

The disclosure relates to an information output apparatus.

A communication system described in JP 2019-211882 A includes a communication device that receives update data of firmware of an air conditioner from a server and transmits a preparation completion notification after the update data has been downloaded by the air conditioner, and an operation terminal that receives input of an instruction to update the firmware of the air conditioner. The operation terminal transmits an update start request to the air conditioner upon receiving the update instruction input from a user.

SUMMARY

In the communication system described in JP 2019-211882 A, firmware of the air conditioner is updated based on the update instruction input from the user. However, with the communication system described in JP 2019-211882 A, when the user fails to notice the preparation completion notification from the communication device, the user cannot recognize that the update preparation of the air conditioner is completed. Thus, the user cannot recognize the completion of the preparation for updating the air conditioner unless he or she checks the update information through searching or the like. Therefore, the control information for the air conditioner may fail to be swiftly updated.

The disclosure is made in view of the problem described above, and an object thereof is to provide an information output apparatus enabling swift updating of the control information for the electronic device.

An information output apparatus according to an aspect of the disclosure includes a communication unit, a determination unit, an output unit, and a control unit. The communication unit receives update preparation completion information for an electronic device. The update preparation completion information indicates that update preparation for the electronic device is completed. The electronic device causes a notification to be issued indicating that control information can be updated. The determination unit determines whether current time reaches preset time. The output unit outputs update executable information. The update executable information indicates that the electronic device can be updated. The control unit controls the communication unit to make the communication unit receives the update preparation completion information, and when the determination unit determines that the current time reaches the preset time, the output unit outputs the update executable information.

With the information output apparatus according to the disclosure, the control information for the electronic device can be swiftly updated.

BRIEF DESCRIPTION OF DRAWINGS

The disclosure will be described with reference to the accompanying drawings, wherein like numbers reference like elements.

DESCRIPTION OF EMBODIMENTS

Figure 1:
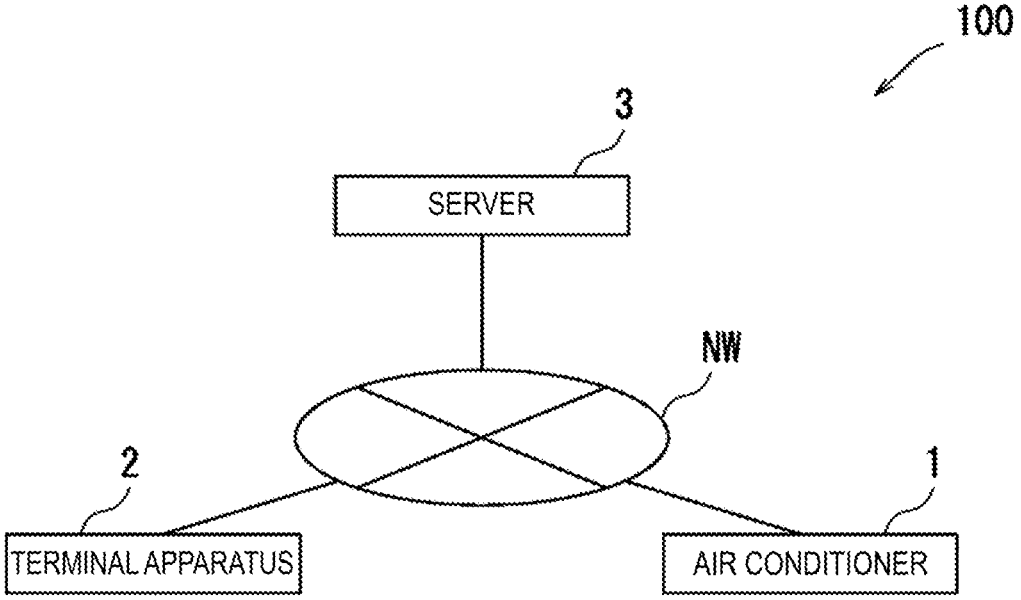
FIG. 1 is a diagram illustrating an electronic device system according to an embodiment of the disclosure.

Embodiments of the disclosure will be described hereinafter with reference to the accompanying drawings. In the drawings, the same or equivalent components are denoted by the same reference numerals and signs, and description thereof is not repeated.

An electronic device system 100 according to an embodiment of the disclosure will be described with reference to FIG. 1. FIG. 1 is a diagram illustrating the electronic device system 100. As illustrated in FIG. 1, the electronic device system 100 includes an air conditioner 1, a terminal apparatus 2, and a server 3. The air conditioner 1 is an example of an "electronic device". The air conditioner 1 also serves as an "information output apparatus" having an information output function.

The air conditioner 1 is, for example, a stationary air conditioner. The air conditioner 1 is installed in a room. The air conditioner 1 blows temperature adjusted air.

The terminal apparatus 2 is, for example, a tablet or a smartphone. The terminal apparatus 2 is carried by a user. The terminal apparatus 2 is used for operating the air conditioner 1.

The server 3 is disposed in, for example, a manufacturer of the air conditioner 1. The server 3 includes a processor such as a central processing unit (CPU).

The air conditioner 1, the terminal apparatus 2, and the server 3 communicate with each other over a network NW. The network NW includes, for example, the Internet, a local area network (LAN), and a public telephone network. In addition, a wireless LAN router (not illustrated) may be installed in the room. The wireless LAN router is, for example, a WiFi router. The air conditioner 1 and the terminal apparatus 2 communicate with the server 3 via the wireless LAN router.

Figure 2:
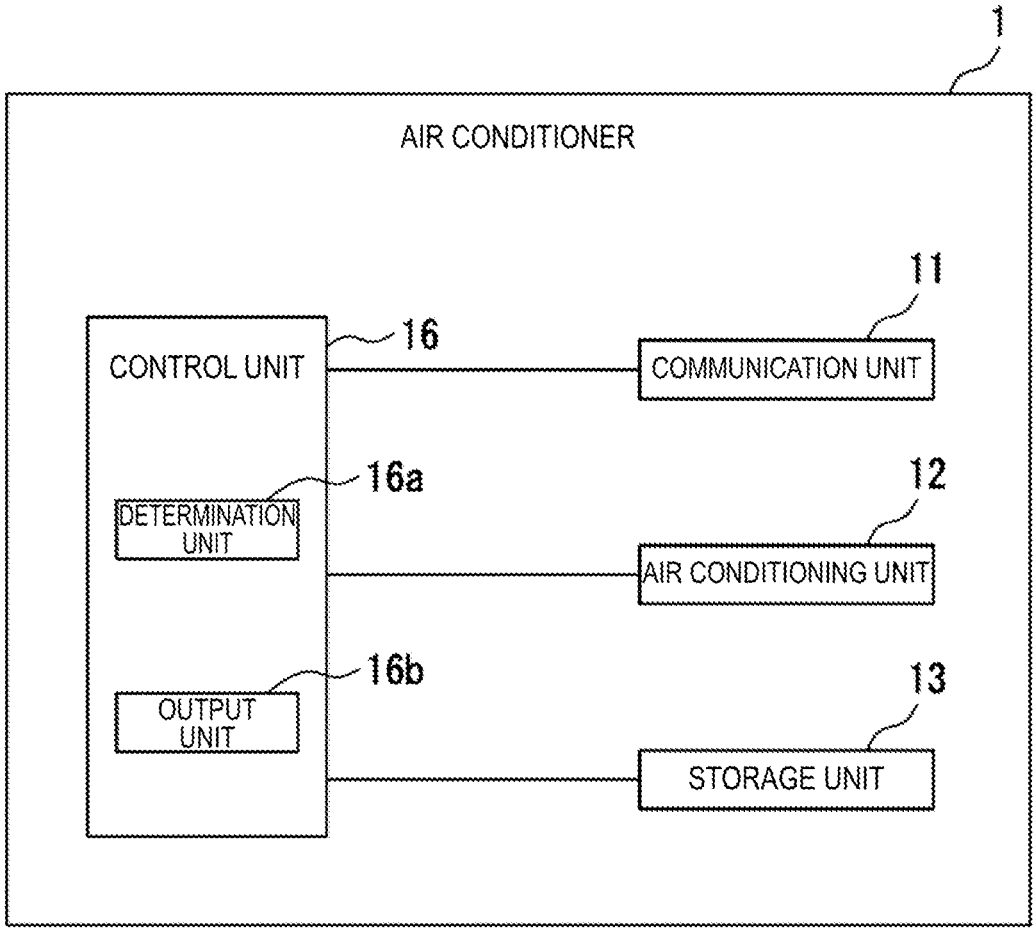
FIG. 2 is a block diagram illustrating an air conditioner according to the embodiment.

FIG. 2 is a block diagram illustrating the air conditioner 1 according to the embodiment. As illustrated in FIG. 2, the air conditioner 1 includes a communication unit 11, an air conditioning unit 12, a storage unit 13, and a control unit 16.

The communication unit 11 transmits information to the terminal apparatus 2 or the server 3 and receives information from the terminal apparatus 2 or the server 3. The communication unit 11 is connected to the network NW. The communication unit 11 is, for example, a network interface controller that performs communications in accordance with a predetermined communication protocol, or performs communication in accordance with a WiFi communication standard. The predetermined communication protocol is, for example, a Transmission Control Protocol/Internet Protocol (TCP/IP) protocol suite (that is, the Internet Protocol Suite).

Specifically, the communication unit 11 transmits update information for the air conditioner 1 to the server 3. The update information is information related to update of control information (firmware) for controlling the air conditioner 1. Specifically, the information includes information indicating whether the air conditioner 1 needs to be changed or corrected regarding the control information. Preferably, the update information further includes a version and a latest update timing of the control information.

The communication unit 11 receives update preparation completion information for the air conditioner 1. The update preparation completion information is information indicating that the update preparation for the air conditioner 1 has been completed. The air conditioner 1 issues a notification indicating that the control information can be updated. The communication unit 11 receives the control information of the latest version from the server 3. The air conditioner 1 downloads the received control information of the latest version and completes the update preparation. In a case where the server 3 is an information output apparatus, the server 3 can confirm the completion of the update preparation at a timing when the update preparation completion information is received from the air conditioner 1. In the embodiment, the air conditioner 1 is an information output apparatus. Upon receiving the control information of the latest version from the server 3, the air conditioner 1 continuously executes downloading of the control information of the latest version. Therefore, the reception of the control information of the latest version from the server 3 can be regarded as the reception of the update preparation completion information. The update preparation completion information is hereinafter referred to as first information F1.

The air conditioning unit 12 adjusts the temperature of air and blows the temperature adjusted air. The air conditioning unit 12 includes, for example, a heat exchanger, a fan, a compressor, and the like (none of which is illustrated). A temperature adjustment unit adjusts the temperature of the air. A blower unit blows the air. The air conditioning unit 12 is controlled by the control unit 16 based on operation information of the air conditioner 1.

The storage unit 13 includes a storage device, and stores computer programs such as software and data. Specifically, the storage unit 13 includes a main storage device such as a semiconductor memory, and an auxiliary storage device such as a semiconductor memory, a solid-state drive, and/or a hard disk drive. The storage unit 13 may include a removable medium.

The control unit 16 includes a processor such as a CPU. The processor of the control unit 16 executes a computer program stored in the storage unit 13 to function as a determination unit 16*a* and an output unit 16*b*.

The determination unit 16*a* determines whether the current time has reached preset time. The preset time is, for example, time determined by the user himself/herself or time based on the lifestyle of the user. The time based on the lifestyle of the user is time at which the user can check the terminal apparatus 2, example of which including time of break the user takes or time before he or she sleeps. Hereinafter, the preset time may be referred to as first time T1. In addition, time earlier than the first time T1 by a predetermined period of time may be referred to as second time T2.

The output unit 16*b* outputs update executable information indicating the air conditioner 1 can be updated. Specifically, the air conditioner 1 outputs the update executable information, in response to satisfaction of a condition such as completion of the downloading of the control information of the latest version, and determination that the first time T1 has arrived. Hereinafter, the update executable information is referred to as second information F2. The second information F2 is information obtained by adding a time factor to the first information F1.

The control unit 16 controls each element of the air conditioner 1. Specifically, the control unit 16 controls the communication unit 11 and the air conditioning unit 12 by executing a computer program stored in the storage unit 13.

The control unit 16 controls the communication unit to make the communication unit 11 receive the first information F1. When the determination unit 16*a* determines that the current time has reached the first time T1, the output unit 16*b* outputs the second information F2. Therefore, the second information F2 is output at a timing when the user is likely to be able to check the second information F2. This makes it possible to suppress that the user fails to notice the second information F2. As a result, the control information for the air conditioner 1 can swiftly updated.

Figure 3:
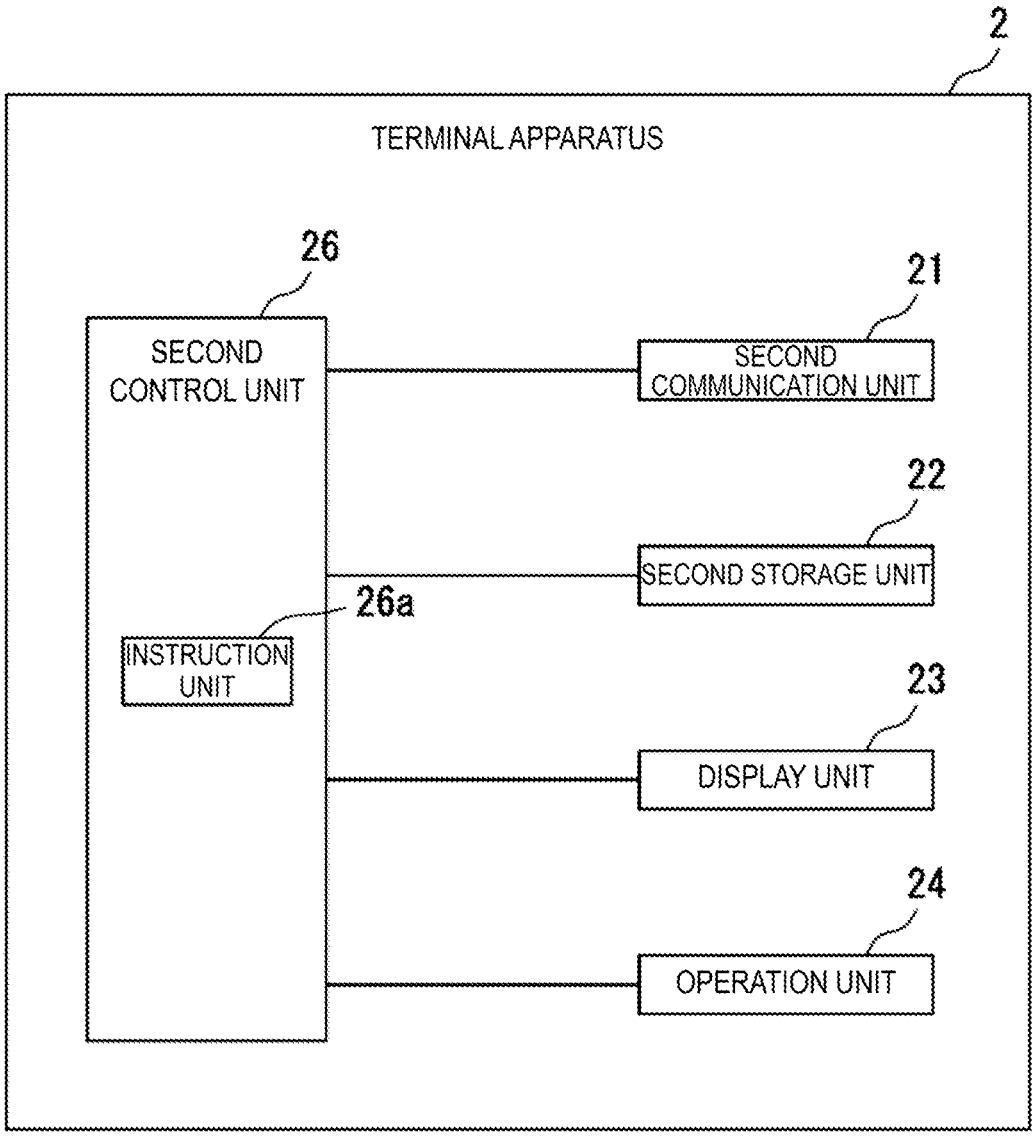
FIG. 3 is a block diagram illustrating a terminal apparatus according to the embodiment.
Figure 4:
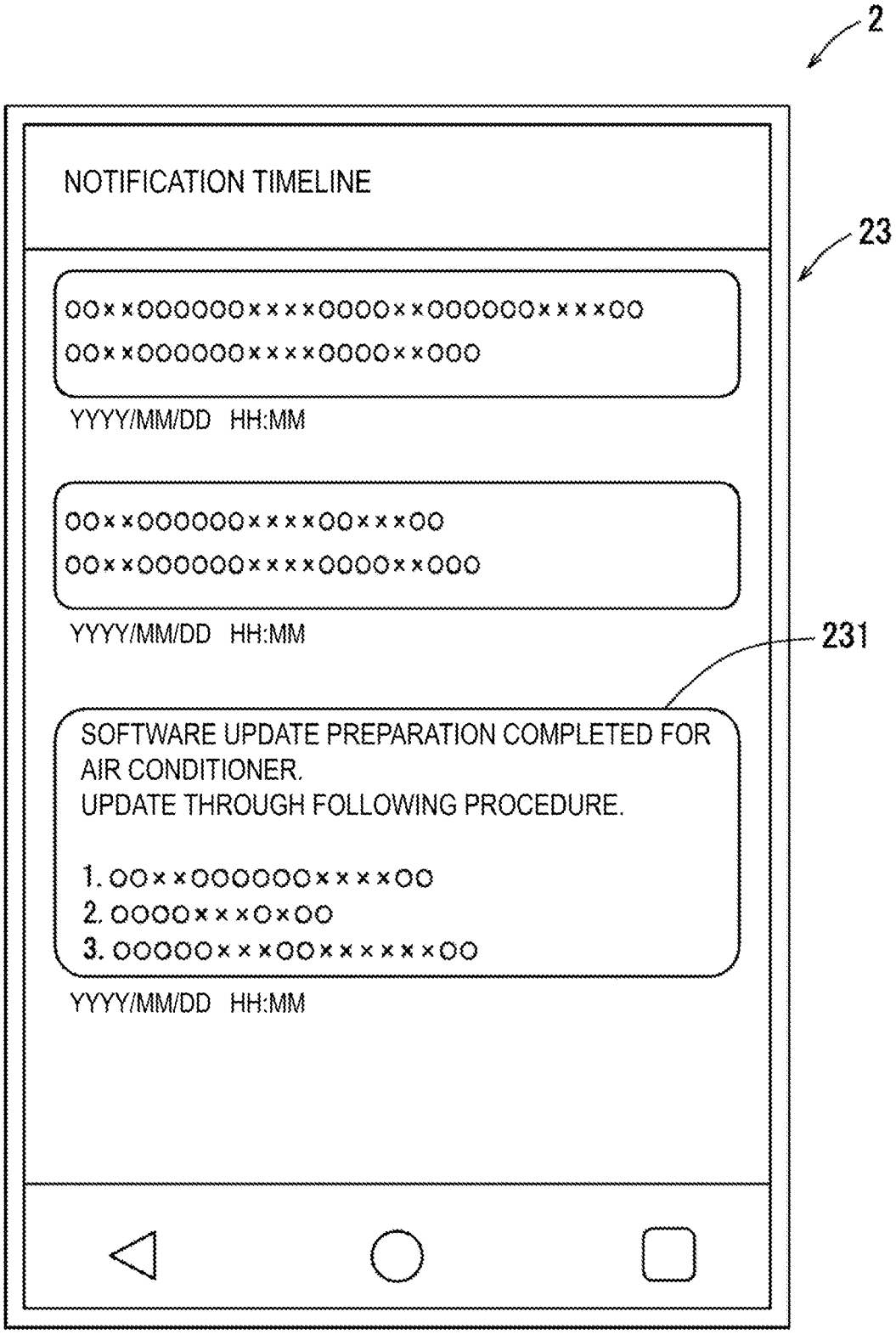
FIG. 4 illustrates an example of an update notification image according to the embodiment.
Figure 5:
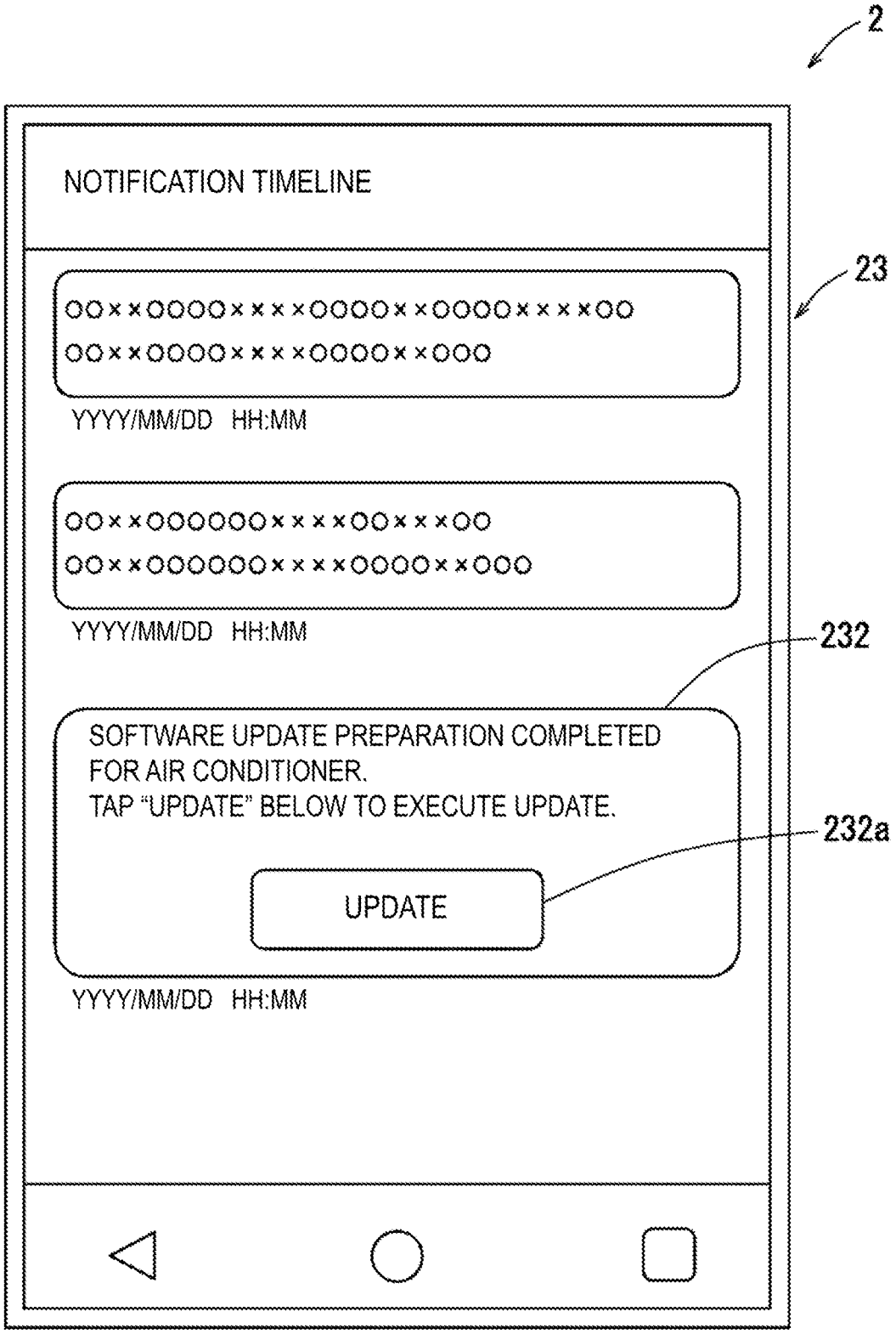
FIG. 5 illustrates an example of another update notification image according to the embodiment.
Figure 6:
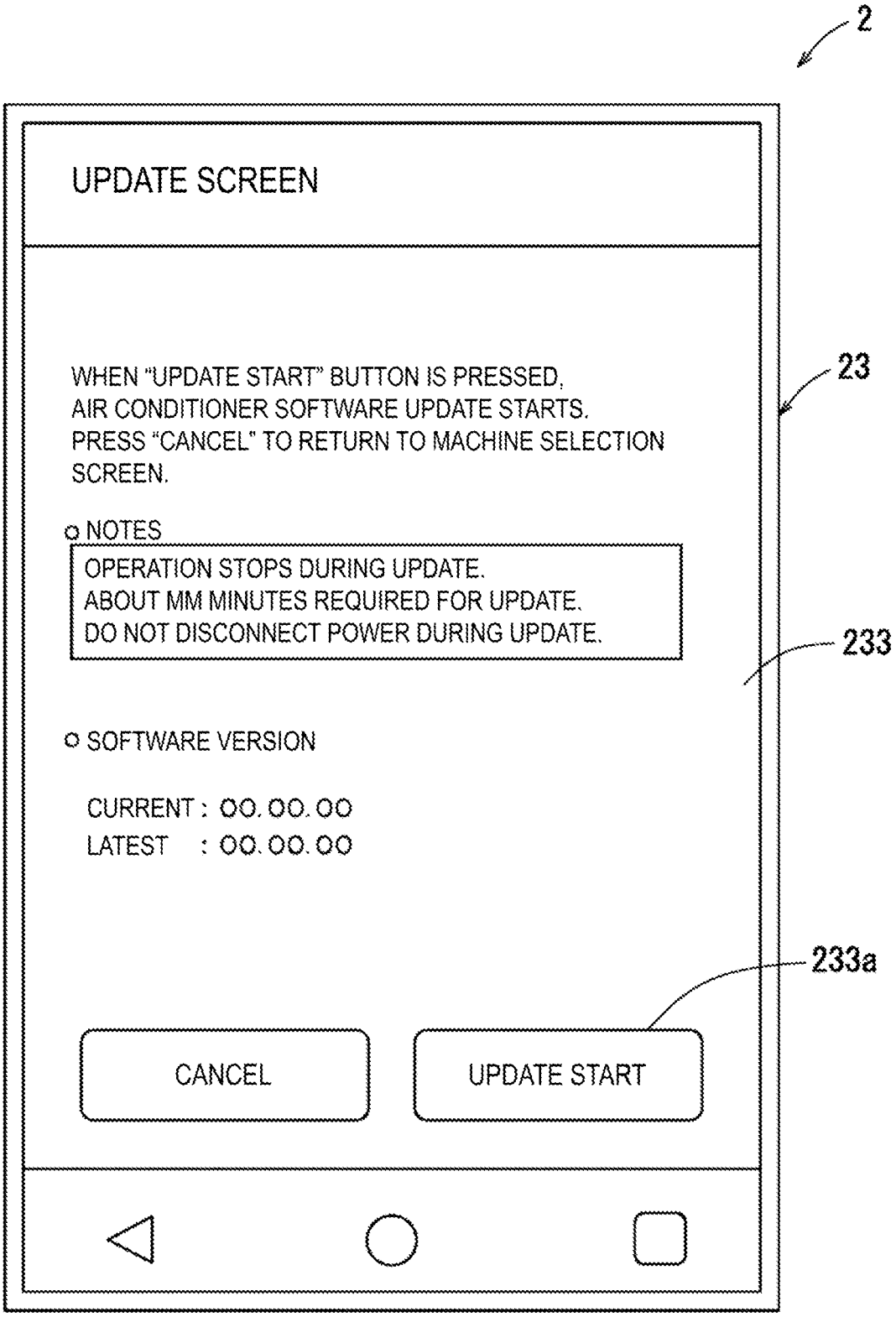
FIG. 6 illustrates an example of an update confirmation image according to the embodiment.
Figure 7:
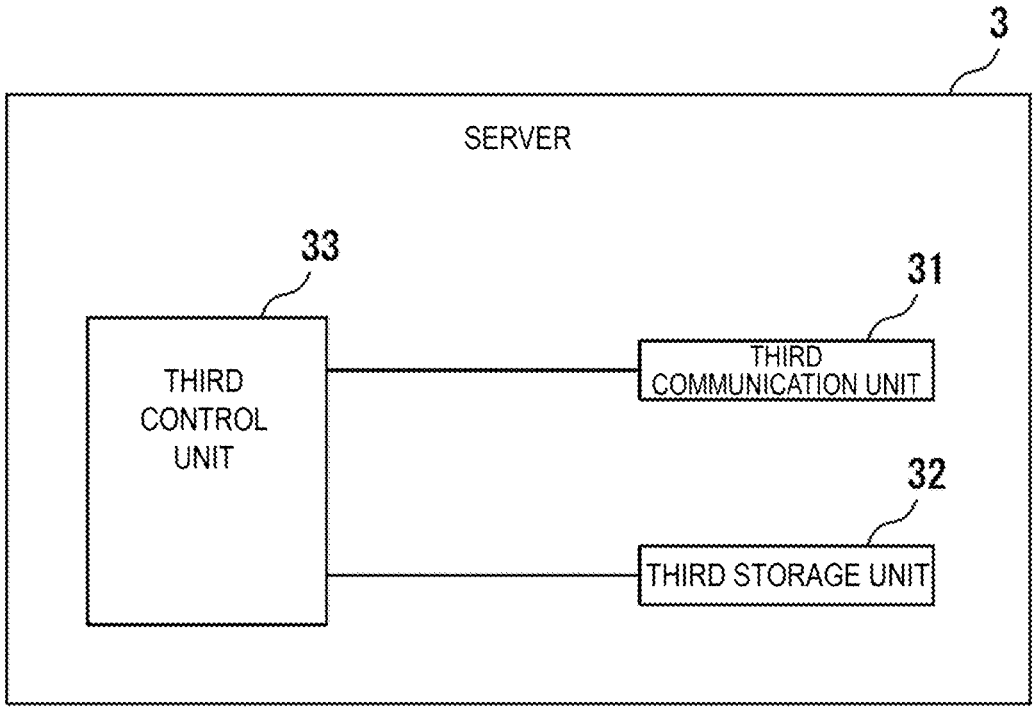
FIG. 7 is a block diagram illustrating a server according to the embodiment.

The electronic device system 100 will be described in detail with reference to FIG. 3 to FIG. 7. FIG. 3 is a block diagram illustrating the terminal apparatus 2 according to the embodiment. FIG. 4 illustrates an example of an update notification image according to the embodiment. FIG. 5 illustrates an example of another update notification image according to the embodiment. FIG. 6 illustrates an example of an update confirmation image according to the embodiment. FIG. 7 is a block diagram illustrating the server 3 according to the embodiment.

The terminal apparatus 2 can be used for operating the air conditioner 1. As illustrated in FIG. 3, the terminal apparatus 2 includes a second communication unit 21, a second storage unit 22, a display unit 23, an operation unit 24, and a second control unit 26.

The second communication unit 21 receives the second information F2 transmitted from the air conditioner 1. The second communication unit 21 is connected to the network NW (see FIG. 1). The second communication unit 21 includes, for example, a network interface controller that performs communications in accordance with a predetermined communication protocol, or communications in accordance with a WiFi communication standard.

The second storage unit 22 includes a storage device and stores an application program (hereinafter, may be referred to as an "application AP"), a computer program, and data. Specifically, the second storage unit 22 includes a main storage device such as a semiconductor memory, and an auxiliary storage device such as a semiconductor memory, a solid-state drive, and/or a hard disk drive. The second storage unit 22 may include a removable medium.

The application AP is, for example, a computer program that makes the display unit 23 display a plurality of operation buttons. The plurality of operation buttons correspond to a plurality of operation modes. In the embodiment, the application AP is downloaded from the server 3 to the terminal apparatus 2 and is updated.

The display unit 23 displays an image. The display unit 23 issues a notification indicating update information related to the update of the air conditioner 1. The display unit 23 corresponds to a notification unit that issues a notification related to the update to the user. The display unit 23 is, for example, a liquid crystal display or an organic electroluminescence display. The display unit 23 is controlled by the second control unit 26 based on input interface information and the application AP. Specifically, the display unit 23 for operating the air conditioner 1 displays an operation image. The display unit 23 displays the plurality of operation buttons.

The operation unit 24 receives a touch operation from the user. The operation unit 24 includes a touch sensor (not illustrated). The touch sensor detects the presence or absence of the touch operation and detects coordinates of the touch operation. For example, the touch sensor includes a pressure sensor, an electrostatic capacitance sensor, or a light sensor. The operation unit 24 outputs a signal corresponding to a user operation to the second control unit 26. The operation unit 24 and the display unit 23 function as a touch panel.

Now, an example of an image displayed on the display unit 23 of the terminal apparatus 2 will be described. As illustrated in FIG. 4 to FIG. 6, the user is notified of the second information F2 using any of update notification image 231, 232 or update confirmation image 233. In other words, the update notification image 231, 232 and the update confirmation image 233 to be displayed include the second information F2. As illustrated in FIG. 4, when the first time T1 is determined to have arrived after the air conditioner 1 has downloaded the control information of the latest version, the user is notified of the second information F2 using the update notification image 231. The update notification image 231 includes an update procedure. The user can update the air conditioner 1 in accordance with the displayed update procedure. The update notification image 232 may be used for the notification of the second information F2, instead of the update notification image 231. As illustrated in FIG. 5, the update notification image 232 displays an operation button 232*a* that can be used by the user to start execution of the update.

To check, at a certain timing, whether the air conditioner 1 needs to be updated, the user can perform an update search operation. The update search operation corresponds to a predetermined input. As illustrated in FIG. 6, when the user performs the update search operation with a predetermined condition satisfied, the update confirmation image 233 is displayed on the display unit 23. The predetermined condition is, for example, satisfied when the terminal apparatus 2 has already received the second information F2 and the control information of the air conditioner 1 has not been updated yet. The update confirmation image 233 displays an operation button 233*a* that can be used for starting execution of update. The update confirmation image 233 also includes matters to be noted during the update. The matters to be noted are, for example, operation stops during update, time required for update, and prohibition of power-off during update.

The second control unit 26 includes a processor such as a CPU. As illustrated in FIG. 3, the processor of the second control unit 26 executes the computer program stored in the second storage unit 22 and functions as an instruction unit 26*a*.

When receiving the update search operation by the user, the instruction unit 26*a* instructs update necessity confirmation for confirming the presence or absence of the control information for executing the update. Specifically, the instruction unit 26*a* requests the server 3 for the latest version of the control information and the current version of the control information for the air conditioner 1 held.

When the second communication unit 21 receives the second information F2, the second control unit 26 makes the display unit 23 issue the notification indicating the update information. The second control unit 26 controls each element of the terminal apparatus 2. Specifically, the second control unit 26 controls the second communication unit 21, the display unit 23, and the operation unit 24 by executing the computer program and the application AP stored in the second storage unit 22.

The second control unit 26 makes the display unit 23 issue the notification indicating the result of the update necessity confirmation, and makes the display unit 23 issue the notification indicating the update information when the update search operation is received after the second information F2 has been received. The update information is, for example, the second information F2. In a state where the second control unit 26 has already received the second information F2, when the user performs the update search again, the user is highly likely to have failed to notice the notification indicating the second information F2 issued in the past. Therefore, it is determined that the user has failed to notice the second information F2, when the user performs the update search again in a state where the second control unit 26 has already received the second information F2. As a result, the user that has once failed to notice the second information F2 can recognize the second information F2 at any timing.

When the second communication unit 21 receives update completion information indicating that the update of the air conditioner 1 has been completed based on the second information F2 after the second information F2 has been received, the second control unit 26 does not make the display unit 23 issue the notification indicating the second information F2. When the update completion information based on the second information F2 is received, the control information of the air conditioner 1 is of the latest version. Thus, the user does not need to be notified of the second information F2. Therefore, since no unnecessary notification is issued to the user, the user does not feel annoyed by the notification. The update completion information is hereinafter referred to as third information F3.

As illustrated in FIG. 7, the server 3 includes a third communication unit 31, a third storage unit 32, and a third control unit 33.

The third communication unit 31 is connected to the network NW (see FIG. 1). The third communication unit 31 includes, for example, a network interface controller that performs communications in accordance with a predetermined communication protocol. The predetermined communication protocol is, for example, the TCP/IP protocol suite (that is, the Internet Protocol Suite).

The third storage unit 32 includes a storage device, and stores computer programs such as software and data. Specifically, the third storage unit 32 includes a main storage device such as a semiconductor memory, and an auxiliary storage device such as a semiconductor memory, a solid-state drive, and/or a hard disk drive. The third storage unit 32 may include a removable medium.

The third control unit 33 includes a processor such as a CPU. The third control unit 33 controls each element of the server 3. Specifically, the third control unit 33 controls the third storage unit 32 and the third communication unit 31, by executing a computer program stored in the third storage unit 32.

Figure 8:
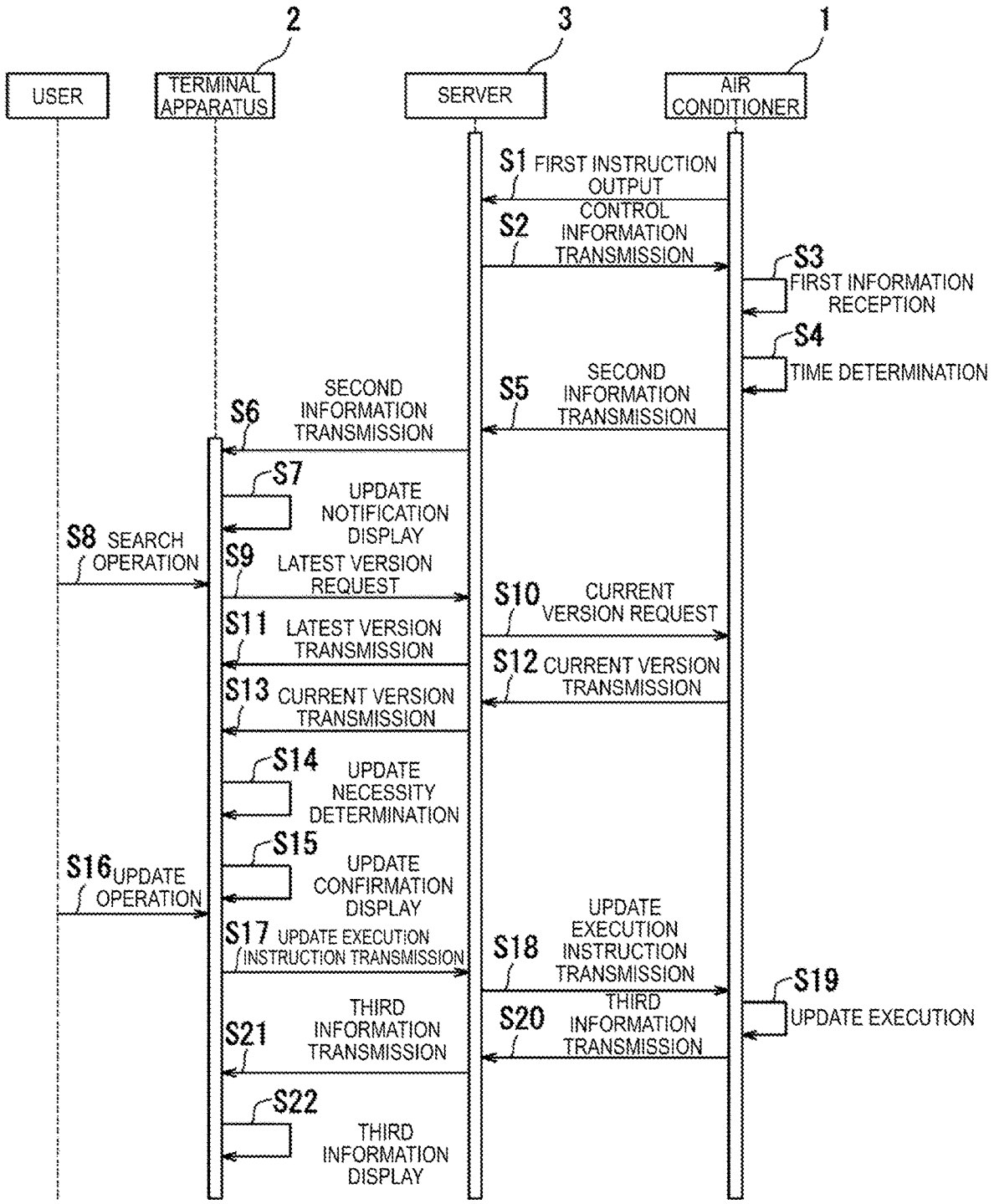
FIG. 8 is a sequence diagram of the electronic device system according to the embodiment.

Next, processing in the electronic device system 100 according to the embodiment will be described with reference to FIG. 8. FIG. 8 is a sequence diagram of the electronic device system 100 according to the embodiment.

As illustrated in FIG. 8, in step S1, the output unit 16*b* outputs a first instruction R1 when the determination unit 16*a* determines that the current time has reached the second time T2. The first instruction R1 is an update preparation start instruction for starting the update preparation. The air conditioner 1 checks whether the new control information requiring the version update to the server 3. The second time T2 is earlier than the first time T1 by a predetermined period of time. The predetermined period of time is set to be, for example, the same as that between the start and the end of the downloading of the control information by the air conditioner 1. Thus, the first time T1 can be close to the timing at which the downloading of the control information by the air conditioner 1 ends. This means that the second information F2 notification timing can be close to the first time T1. Thus, the user can be notified of the second information F2 when he or she can surely check the information. As a result, the user can be more effectively suppressed from failing to notice the second information F2.

In step S2, when there is new control information requiring the version update, the server 3 transmits such new control information to the air conditioner 1. In step S3, the communication unit 11 receives the new control information requiring the version update from the server 3. At the same time as the reception, the control unit 16 downloads the received control information and stores the control information in the storage unit 13. In other words, the communication unit 11 can be regarded as having received the first information F1. The first information F1 is information indicating that the air conditioner 1 has downloaded the control information for updating. Therefore, the air conditioner 1 can easily determine whether there is the control information requiring the version update.

In step S4, the determination unit 16*a* determines whether the current time is the first time T1. When the current time is the first time T1, the air conditioner 1 transmits the second information F2 to the server 3 in step S5. In step S6, the server 3 transmits the second information F2 to the terminal apparatus 2. In step S7, the display unit 23 of the terminal apparatus 2 displays the update notification image 231 or the update notification image 232 (see FIGS. 4 and 5). The user can update the air conditioner 1 based on the update notification image 231 or the update notification image 232.

Next, a case where the user performs the update search operation will be described. It is assumed that the user has not performed the update operation on the air conditioner 1 after the update notification image has been displayed. As illustrated in FIG. 8, in step S8, the user performs the update search operation using the terminal apparatus 2. In step S9, the terminal apparatus 2 makes the instruction unit 26*a* output a second instruction R2. The second instruction R2 is an update necessity confirmation instruction for making the server 3 make a query about the latest version of the control information, to check the current version and the latest version of the control information of the air conditioner 1.

In step S10, the server 3 requests the air conditioner 1 for the current version of the control information. At the same time, in step S11, the server 3 transmits the latest version of the control information held thereby, to the terminal apparatus 2. In step S12, the air conditioner 1 transmits the current version of the control information to the server 3. In step S13, the server 3 transmits the current version of the control information for the air conditioner 1 to the terminal apparatus 2.

In step S14, the terminal apparatus 2 compares the current version of the control information with the latest version of the control information. The terminal apparatus 2 determines whether the update is required, based on the result of the comparison. In step S15, when the current version of the control information is different from the latest version of the control information, the display unit 23 of the terminal apparatus 2 displays the update confirmation image 233 (see FIG. 6) as a result of the update necessity confirmation.

In step S16, when the control information for the air conditioner 1 needs to be updated, the user operates the operation button 233*a* on the update confirmation image 233 to execute the update. In step S17, the terminal apparatus 2 transmits an update execution instruction to the server 3. In step S18, the server 3 transmits the update execution instruction to the air conditioner 1.

In step S19, the air conditioner 1 updates the control information of the latest version downloaded. After updating the control information, in step S20, the air conditioner 1 transmits the third information F3 to the server 3. The third information F3 is information indicating that the control information requiring the version update has been updated. In step S21, the server 3 transmits the third information F3 to the terminal apparatus 2. In step S22, the terminal apparatus 2 displays the third information F3.

Figure 9:
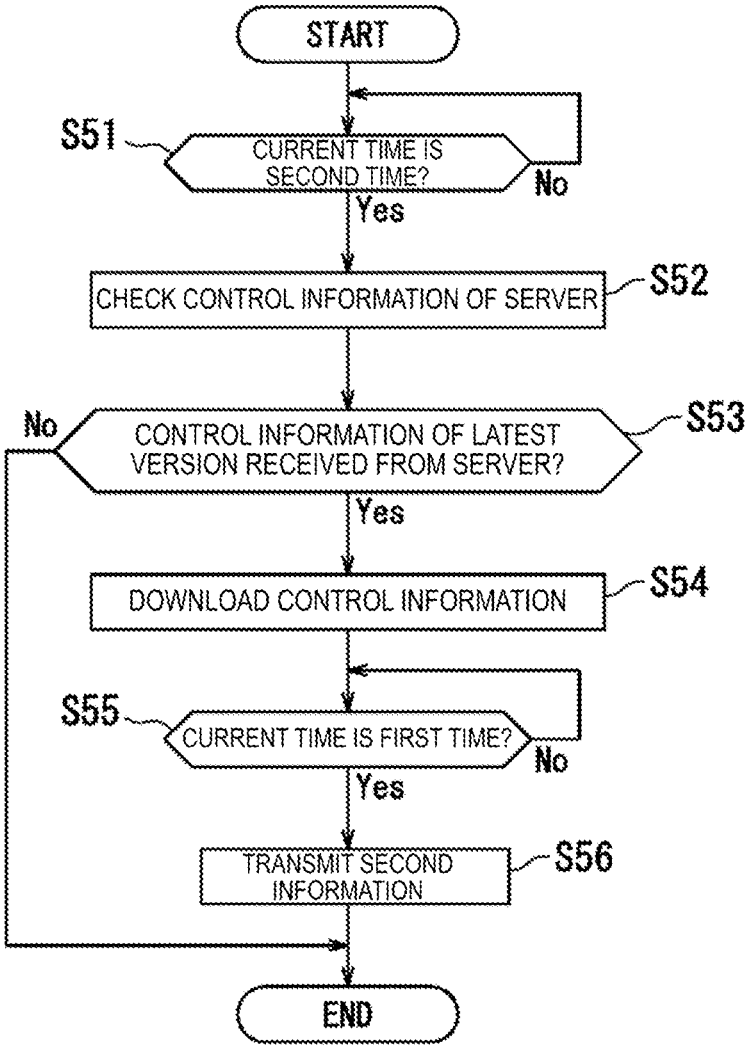
FIG. 9 is a flowchart illustrating an operation of the air conditioner according to the embodiment.

Next, processing in the electronic device system 100 according to the first embodiment will be described with reference to FIG. 9 to FIG. 11. FIG. 9 is a flowchart illustrating an operation of the air conditioner 1 according to the embodiment. As illustrated in FIG. 9, the processing of the air conditioner 1 includes step S51 to step S56. Step S51 to step S56 are executed when the processor of the air conditioner 1 executes a computer program.

As illustrated in FIG. 9, in step S51, the determination unit 16*a* determines whether the current time has reached the second time T2. When the determination unit 16*a* determines that the current time has not reached the second time T2 yet (No in step S51), the time measurement continues. When the determination unit 16*a* determines that the current time has reached the second time T2 (Yes in step S51), the processing proceeds to step S52.

When it is determined Yes in step S51, the control unit 16 checks the control information held by the server 3 in step S52. In order to confirm whether the server 3 has the control information for updating, the output unit 16*b* outputs the first instruction R1. The processing then proceeds to step S53.

In step S53, it is determined whether the communication unit 11 has received the control information of the latest version from the server 3. When the control unit 16 determines that the control information of the latest version has not been received from the server 3 (No in step S53), the processing ends. When the control unit 16 determines that the control information of the latest version has been received from the server 3 (Yes in step S53), the processing proceeds to step S54.

When it is determined Yes in step S53, the control unit 16 stores the control information of the latest version received from the server 3 in the storage unit 13 in step S54. The processing then proceeds to step S55.

In step S55, the determination unit 16*a* determines whether the current time has reached the first time T1. When the determination unit 16*a* determines that the current time has not reached the first time T1 yet (No in step S55), the time measurement continues. When the determination unit 16*a* determines that the current time has reached the first time T1 (Yes in step S55), the processing proceeds to step S56.

When it is determined Yes in step S55, the control unit 16 controls the communication unit 11 in step S56. The communication unit 11 transmits the second information F2 to the server 3. When the processing of step S56 ends, the processing ends. When the communication unit 11 has received the third information F3 indicating that the update of the air conditioner 1 has been completed based on the first information F1, the output unit 16*b* does not output the second information F2 even if the determination unit 16*a* determines that the current time has reached the first time T1.

Based on FIG. 10 and FIG. 11, the processing of the terminal apparatus 2 will be described. FIG. 10 and FIG. 11 are flowcharts illustrating an example of an operation of the terminal apparatus 2 according to the embodiment. As illustrated in FIG. 10 and FIG. 11, the processing of the terminal apparatus 2 includes step S61 to step S69. Step S61 to step S69 are executed when the processor of the terminal apparatus 2 executes a computer program.

Figure 10:
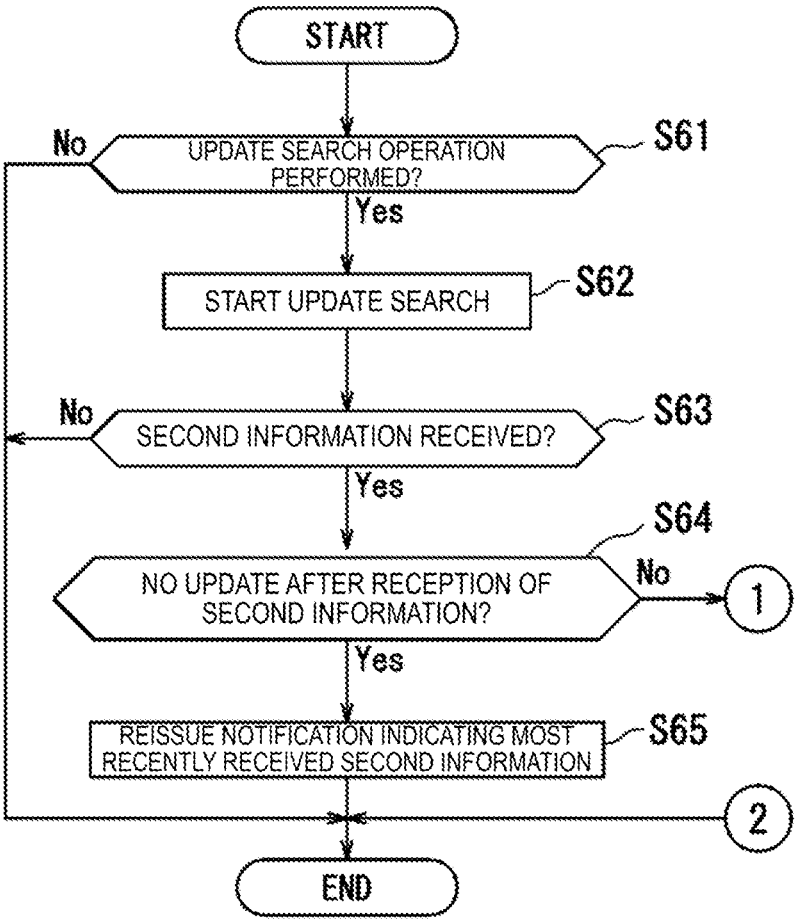
FIG. 10 illustrates part of a flowchart illustrating an operation of the terminal apparatus according to the embodiment.
Figure 11:
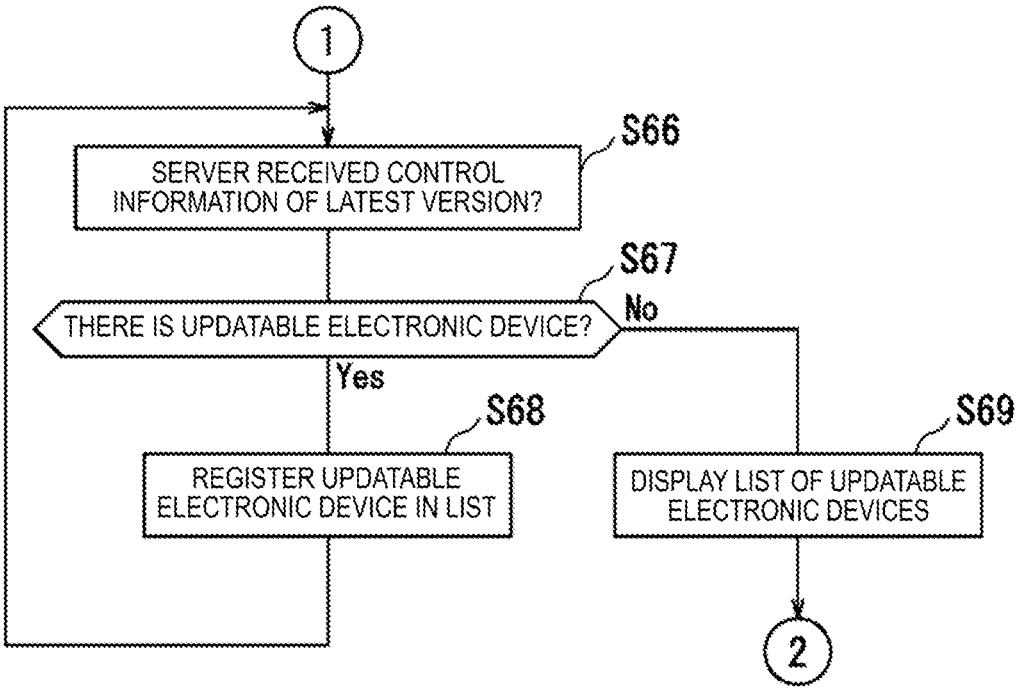
FIG. 11 illustrating the remaining part of the flowchart illustrating the operation of the terminal apparatus according to the embodiment.

As illustrated in FIG. 10, in step S61, the second control unit 26 determines whether the user has performed the update search operation. When the second control unit 26 determines that the user has not performed the update search operation (No in step S61), the processing ends. When the second control unit 26 determines that the user has performed the update search operation (Yes in step S61), the processing proceeds to step S62.

When it is determined Yes in step S61, the second control unit 26 searches for the update for control information including the control information for the air conditioner 1 in step S62. The processing then proceeds to step S63.

In step S63, the second control unit 26 determines the second communication unit 21 has received the second information F2. When the second control unit 26 determines that the second communication unit 21 has not received the second information F2 (No in step S63), the processing ends. When the second control unit 26 determines that the second communication unit 21 has received the second information F2 (Yes in step S63), the processing proceeds to step S64.

When it is determined Yes in step S63, the second control unit 26 determines whether the update is not executed after the second communication unit 21 has received the second information F2 in step S64. When the second control unit 26 determines whether the update is executed after the second communication unit 21 has received the second information F2 (No in step S64), the processing proceeds to step S66. When the second control unit 26 determines whether the update is not executed after the second communication unit 21 has received the second information F2 (Yes in step S64), the processing proceeds to step S65.

When it is determined Yes in step S64, the second control unit 26 reissues the notification indicating the second information F2 most recently received in step S65. Since the update is not executed even though the update is executable, the second control unit 26 displays the update notification image 231 or the update notification image 232 (see FIG. 4 and FIG. 5) again. When the processing of step S65 ends, the processing ends.

When it is determined No in step S64, the second control unit 26 makes an inquiry, to the server 3, about the control information of the latest version in accordance with the second instruction R2 in step S66. The processing then proceeds to step S67.

In step S67, the second control unit 26 determines whether there is an updatable electronic device. In the embodiment, the terminal apparatus 2 manages update information for electronic devices other than the air conditioner 1. In addition, the terminal apparatus 2 can update an electronic device other than the air conditioner 1. When the second control unit 26 determines that there is no updatable electronic device (No in step S67), the processing proceeds to step S69. When the second control unit 26 determines that there is an updatable electronic device (Yes in step S67), the processing proceeds to step S68.

When it is determined Yes in step S67, the second control unit 26 registers the updatable electronic device in a list (not illustrated) in the second storage unit 22 in step S68. When the processing in step S68 is completed, the processing returns to step S66.

When it is determined No in step S67, the second control unit 26 makes the display unit 23 issue a notification about the updatable electronic device in step S69. Specifically, the second control unit 26 makes the display unit 23 display the list of the updatable electronic devices registered. When the processing of step S69 ends, the processing ends.

The embodiments of the disclosure have been described above with reference to the drawings. However, the disclosure is not limited to the embodiments described above, and the disclosure can be implemented in various modes without departing from the gist thereof. For example, some components may be removed from all of the components described in the embodiments. The drawings primarily schematically illustrate each of the constituent elements for the sake of easier understanding. In addition, each of the components described in the above embodiments is exemplary and is not particularly limited, and various modifications can be made within a range that does not substantially depart from the effects of the disclosure.

(1) In the embodiment described above with reference to FIG. 1 to FIG. 11, an example is described in which the air conditioner 1 also serves as the information output apparatus having the information output function. However, the disclosure is not limited to this. The server 3 may serve as the information output apparatus having the information output function. In this case, the second information F2 is directly transmitted from the server 3 to the terminal apparatus 2.

(2) In the embodiment described above with reference to FIG. 1 to FIG. 11, an example is described in which the display unit 23 serving as the notification unit is provided to the terminal apparatus 2. However, the disclosure is not limited to this. The notification unit may be provided to the air conditioner 1.

(3) In the embodiment described above with reference to FIG. 1 to FIG. 11, the air conditioner 1 is described as an example of the electronic device. However, the disclosure is not limited to this. The electronic device may be an air conditioner including an ion generation device, or may be another electronic device.

INDUSTRIAL APPLICABILITY

The disclosure provides an information output apparatus, and the provided information output apparatus has industrial applicability.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. An information output system comprising:

an electronic device; and a terminal apparatus configured to operate the electronic device, wherein the electronic device comprises:

a first communication interface, one or more first processors, and a first memory, wherein the one or more first processors are configured to:

receive, via the first communication interface, update preparation completion information indicating that update preparation for control information of the electronic device has been completed, determine whether a current time has reached a preset time stored in the first memory, and when the current time is determined to have reached the preset time, generate update executable information indicating that an update of the electronic device is executable, and transmit the update executable information via the first communication interface, wherein the terminal apparatus comprises:

a second communication interface configured to receive the update executable information, a display configured to display update information corresponding to the update executable information, a second memory configured to store the update executable information, one or more second processors configured to control the display of the update information, and an operation device configured to receive, as a predetermined input, an update search operation for the electronic device, and wherein the one or more second processors are configured to control the display of the update information by:

upon receiving the update executable information via the second communication interface, storing the update executable information in the second memory, and causing the display to display the update information corresponding to the update executable information, and when the predetermined input is received by the operation device and the control information of the electronic device has not been updated after receiving the update executable information, causing the display to redisplay the update information corresponding to the update executable information stored in the second memory.

2. The information output system according to claim 1, wherein the update preparation completion information comprises information indicating that the electronic device downloads the control information for the update of the electronic device.

3. The information output system according to claim 2, wherein the one or more first processors are further configured to cause an update preparation start instruction to be output to start the update preparation when the current time is determined to be earlier than the preset time by a predetermined period of time.

4. The information output system according to claim 3, wherein, when the first communication interface receives update completion information indicating that the update of the electronic device is completed based on the update preparation completion information, the one or more first processors are further configured to refrain from transmitting the update executable information even when the current time is determined to have reached the preset time.

5. The information output system according to claim 1, wherein the one or more second processors are further configured to refrain from causing the display to display the update information corresponding to the update executable information when the second communication interface receives update completion information indicating that the update of the electronic device is completed after the update executable information is received.

* * * * *